US010524526B2

(12) United States Patent
Voy

(10) Patent No.: US 10,524,526 B2
(45) Date of Patent: Jan. 7, 2020

(54) PORTABLE POCKET

(71) Applicant: Hyatt Voy, Bozeman, MT (US)

(72) Inventor: Hyatt Voy, Bozeman, MT (US)

( * ) Notice: Subject to any disclaimer, the term of this patent is extended or adjusted under 35 U.S.C. 154(b) by 0 days.

(21) Appl. No.: 16/373,709

(22) Filed: Apr. 3, 2019

(65) Prior Publication Data

US 2019/0313718 A1 Oct. 17, 2019

Related U.S. Application Data

(60) Provisional application No. 62/655,967, filed on Apr. 11, 2018.

(51) Int. Cl.

| | |
|---|---|
| ***A41D 27/20*** | (2006.01) |
| ***A45C 11/00*** | (2006.01) |
| ***A45C 13/10*** | (2006.01) |
| *A47G 9/10* | (2006.01) |

(52) U.S. Cl.

CPC ..... *A41D 27/205* (2013.01); *A45C 11/00* (2013.01); *A45C 13/103* (2013.01); *A41D 2300/322* (2013.01); *A45C 2011/002* (2013.01); *A47G 9/1045* (2013.01)

(58) Field of Classification Search

CPC ..... A41D 27/20; A41D 27/205; Y10T 24/13; A45C 2011/002

See application file for complete search history.

(56) References Cited

U.S. PATENT DOCUMENTS

| | | | | |
|---|---|---|---|---|
| 3,840,901 | A * | 10/1974 | Eyster | A41D 27/20 2/247 |
| 4,266,300 | A * | 5/1981 | Partridge | A41D 27/20 2/247 |
| 4,365,355 | A * | 12/1982 | Off | A41D 27/204 2/247 |
| 5,499,403 | A * | 3/1996 | Harrigan | A01K 5/0114 2/247 |
| 5,737,775 | A * | 4/1998 | Schwartz | A41D 27/20 2/243.1 |
| 6,397,398 | B1 * | 6/2002 | Herder | A41D 27/20 2/249 |
| 6,477,710 | B1 * | 11/2002 | Ojoyeyi | A41D 13/1236 2/114 |
| 6,681,404 | B1 * | 1/2004 | Adlard | A41D 13/1245 2/94 |

(Continued)

OTHER PUBLICATIONS

"Peel and Stick Add-On Polypropylene Filing Pockets" https://express.google.com/u/0/product/6671880061736704777_10573196581807413354_118724597.

*Primary Examiner* — Tajash D Patel

(57) ABSTRACT

A pocket attachable to a pillow case or in the vicinity of a place of rest is convenient for keeping small electronic devices close to a user's head and hands so that the device can be used or kept close by while resting with a pillow. The bottom of the pocket includes an aperture so that a charging or data cable may be attached to the device in the pocket. By inserting a finger in that aperture the device may be easily displaced from below and removed from the pocket. The invention is useful for users who wish to durably affix a pocket to a pillow case or anywhere in the vicinity of a place of rest without resorting to sewing or home improvement skills and tools or machines which they may not possess nor desire to own.

21 Claims, 4 Drawing Sheets

(56) References Cited

U.S. PATENT DOCUMENTS

| | | | | |
|---|---|---|---|---|
| 6,826,782 | B2 * | 12/2004 | Jordan | A41D 1/005 2/94 |
| 8,156,878 | B2 * | 4/2012 | Lazar | A41D 13/1281 112/475.09 |
| 8,607,363 | B2 * | 12/2013 | Klann | G06F 1/163 2/115 |
| 8,959,679 | B1 | 2/2015 | Everds et al. | |
| 2012/0060261 | A1 | 3/2012 | Raviv | |
| 2012/0317701 | A1 * | 12/2012 | Bohun | A41D 27/20 2/251 |
| 2014/0231277 | A1 | 8/2014 | Ponski | |
| 2014/0259299 | A1 * | 9/2014 | Sievwright | A41D 27/20 2/252 |
| 2015/0074866 | A1 * | 3/2015 | Diakite | A41D 27/208 2/69 |
| 2017/0143062 | A1 | 5/2017 | Chumbler | |

* cited by examiner

PORTABLE POCKET

CROSS REFERENCE TO RELATED APPLICATION

This application claims the benefit of priority to U.S. Provisional Application 62/655,967, "Portable Pocket" filed Apr. 11, 2018. The entire contents of U.S. Provisional Application 62/655,967, "Portable Pocket" are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to a discrete pocket with an adhesive durably attachable to surfaces of other objects, walls, furniture, or cushions, pillows or coverings used with furniture, seats or beds. The attached pocket provides the convenience of keeping small electronic devices or other desired objects close at hand by the user's head or in view of the user while doing other tasks or resting.

BACKGROUND

As the cornucopia of software for hand held devices continues to proliferate, many people use small, portable devices for all sorts of tasks and convenient functions such as navigation, communication, information searches, and entertainment including media and music playback. People who use these devices extensively want to take them along everywhere, including places they occupy temporarily such as rented hotel rooms, dormitories or work spaces with furniture they do not own, and seating spaces on public transportation vehicles and private vehicles such as aircraft or private vehicles driven for hire by ride sharing services.

Many people want to play music from small devices while they rest or sleep in such spaces. In a state of reduced consciousness while wearing audio headphones or ear buds (small audio speakers inserted at least partially into the ear canal,) it is common that tossing and turning could cast the player onto the floor, or foul the audio cable around a body part or some other object, leading to a number of unpleasant outcomes, such as damage to a device hitting the floor, discomfort of cables wound around a body part, or a sudden, uncomfortable, jarring cable yank directed to the earlobes if any relative motion of the player device versus the head of the listener exceeds the cable length of the ear buds or headset. All of these discomforts could be alleviated if a listener can keep the player close enough to the head to prevent these accidents.

Although pillows and pillow cases have been made with pockets and cavities which can hold speakers, small electronic devices, and fragrant or aromatic pouches such as potpourri and herbal medicines, people do not want to carry these bulky devices as they travel or occupy more temporary spaces where they may want to rest or sleep occasionally. What is wanted is a device or aid for restraining unwanted motion of a small electronic device such as a smartphone or music player, which can be readily affixed to a location near the head of a person who wishes to rest or sleep, but without requiring extensive or skilled installation and which does not create permanent marks or permanent features on objects which may not belong to the user.

Thus, pillows designed for physical therapy such as the support of cervical vertebrae or the spine are outside the scope of the invention. Also, pillows having pockets or apertures or storage cavities are also outside the scope of the invention. Other organizers that have pockets are designed to mount somewhat permanently on walls or furniture and these devices often use hooks or other hardware which create permanent marks on furniture or walls. These are also outside the scope of the invention, as are other devices comprising detachable organizers which attach to or intermate with hooks, pins, magnets, tabs, hardware, or apertures permanently installed on rigid material surfaces, and multiple-pocket organizers. Pocket organizers which include suction cups are also outside the scope of the invention.

BRIEF SUMMARY OF THE INVENTION

A pocket attachable to a pillow case is convenient for keeping small electronic devices close to a user's head and hands so that the device can be used while resting with a pillow. The bottom of the pocket includes an aperture so that a charging or data cable may be attached to the device in the pocket. By inserting a finger in that aperture the device may be easily displaced from below and removed from the pocket.

The invention is useful for users who wish to durably affix a pocket to a pillow case or anywhere in the vicinity of a place of rest without resorting to sewing or home improvement skills and tools or machines which they may not possess nor desire to own.

The invention can be attached to pillows lacking a pocket feature or affixed anywhere in the vicinity of a place of rest including bedsheets, bedsteads, or a nightstand, table, other furniture, or even a wall near a bed or near a chair. The invention can also be affixed to a chair such as to an armrest or a chair back.

The invention can also be affixed anywhere in a dwelling to provide a designated place for certain electronic devices such as smartphones, portable radios, or remote control devices, or for other objects such as car keys, wallets, identification cards, key fobs and the like. These items are commonly misplaced or forgotten, and some people may seek to organize their lives by affixing and arranging one or more such pockets in places that help remind them of tasks at hand. For example, a person who drives to work might need to remember to collect a wallet, an access badge for entry and identification at a secure facility, and a cellular phone. Such person may affix one or more pockets near a door in a house leading to a garage. Another example is a diabetic person who may want to arrange a place to store syringes, drugs, a blood glucose monitor, and test strips all in one place. Such person may affix one or more pockets near a sink or wastebasket, or out of sight of visitors such as on the interior of a cabinet.

Thus the invention provides utility for young and older users alike; younger users want to keep electronic communications devices, gaming devices, and music players close at hand while resting, and older users can reduce incidences of "senior moments" while trying to remember where a smartphone or similar device may have been mislain, by using the invention to create designated and memorable places for important objects.

Unlike caddies or organizers which require hooks, holes or other substantial installation task and permanent marks or damage, the pocket of the invention can be used in rented dwellings and hotel rooms and workspaces generally not owned by the user, or other spaces where the user is generally not allowed to make substantial changes to the building or the furniture.

Thus, a primary objective of the invention is to provide a pocket which can be readily affixed to a number of different surface materials without leaving lasting damage or marks upon objects which a user does not want to or may be disallowed from modifying or making permanent changes thereto. A corollary objective of the invention is that installing or affixing the pocket to a surface not require mechanical tools, great forces, special machines, or special skills.

Another objective of the invention is to provide a pocket for a small handheld electronic device, phone, or music player which can be affixed near a user's head so that its location is known and familiar during states of rest, so that adjustments or tactile commands to the device can be made without great efforts to search for or orient the device while operating at a reduced level of dexterity or consciousness.

Another objective of the invention is to allow a hand-held device to reside in a pocket while admitting the use of a data exchange cable or a power charging cable to be connected to the device.

Some organizer inventions use suction cups to attach to walls. Unfortunately suction cups can only affix to rigid, non-porous surfaces having little or no texture. It is therefore another objective of the invention to provide adhesion or attachment to many different types of materials and fabric which are likely to be found in the vicinity of a place where someone would like to rest or sleep for short or long periods of time.

Many pocket-sized devices have control affordances which can be push-buttons, pressure-sensitive areas, electrostatically sensitive touch pads or electrodes, and touch screens which convert touch or pressure into command inputs to active program command inputs. These command inputs can effect numerous sorts of device behaviors, such as media selection (what music piece or media file to play,) selection within a track or scene (a user wants to repeat a movie scene or a favorite section of music,) audio volume controls, left/right balance, graphic equalizers, and many other screen-operated tasks such as selecting drop-down options on a website, typing texts, entering phone numbers to be called, or panning and rotating maps displayed in navigation programs. Many of these control inputs require that the device register multiple and simultaneous points of contact, and also points of contact which are in motion such as 'swipes.' Sometimes the detected or computed velocity of a swipe is used as an input command to determine scroll speed through a list of items or used as a game command where proportional input controls velocity, force, or intensity of a virtual action within a game environment. Thus three corollary objectives of the invention are: to provide at least a transparent portion of the pocket so that the screen can be viewed while the device is contained therein, to allow access physical controls such as buttons or touch-sensitive areas or sensors of the device, and to allow transmission or conduction of tactile control inputs through the pocket material so that the device can be operated while remaining within the pocket.

Another objective of the invention is to provide a means of closure around at least enough of the perimeter of the device so that it remains secure within the pocket and unlikely to exit and fall free from the pocket.

Another objective of the invention is to allow a person wearing clothing bereft of pockets to conveniently and readily affix a pocket to a garment and immediately derive its benefit. For a pocket closely sized to accommodate a handheld device, a person could enjoy the benefits of the device while leaving his or her hands free for other tasks or motions. An example of this would be affixing a pocket sized for a music player to an exercise garment so that a user may listen to music while exercising or running. Basting or hand-stitching is nearly a lost art among the heaviest users of small electronic devices, and novice attempts look terrible on garments having uniform machine-stitched seams and designs everywhere else. Thus a corollary objective of the invention would be to provide an iron-on adhesive or other adhesive by which to affix a pocket to a garment while retaining a stylish appearance.

Another objective of the invention is to allow a person wearing water resistant or outdoor weather gear to take along a hand-held electronic device in inclement or rainy weather so that the device can perform its own useful functions while shielded or less exposed to the elements.

People who cook often handle, knead, or mix foodstuffs which adhere to their fingers, but with the invention they can use a device to display recipe instructions, and swipe through pages or search the internet for information it while not transferring foodstuffs from their fingers and onto a touch screen of the device. Similarly, a person working on a mechanical repair on an auto, home appliance, or other machine can use a display device for instructional videos and physically interact with a touch screen of the device without transferring dirt, grime, solvents, lubricants, or other unwanted matter onto the touch screen. Thus, another objective of the invention is to provide a pocket for an electronic device which includes an at least partially transparent membrane so that the information displayed by the device can be viewed and tactile inputs to a touch screen of the device can be transmitted through the membrane while the user's fingers may be fouled with other matter, and a corollary objective of the invention is to provide a transparent or mostly transparent shield for a display device which can be easily cleaned.

Some people worry about damage to their electronic communication device by EMP (electromagnetic pulse) or a Carrington event (a solar event causing a massive emission charged particles,) and others sometimes wish to prevent a communication signal arriving to their device at times or places where they do not wish to be obliged to respond to a ringing cell phone or a sound alert that a text message has been received. Also. many smartphones and similar devices constantly interact with GPS satellites and other location reporting systems, but some users may wish to retain their personal privacy while they use a device to access or modify stored data, and so there is a need for a simple and certain method to prevent the device from reporting a user's location to corporate marketing or government surveillance systems. Thus, another objective of the invention is to protect an electronic device from damaging external electromagnetic fields or surges. A corollary objective of the invention is to effectively envelop an electronic device in a Faraday cage so that outside signals cannot reach the device and signals emitted by the device without the consent of the user can be trapped.

A yet further objective of the invention is to provide a convenient and unexpected holster for a compact weapon or a defense tool such as an electroshock device, an edged weapon or puncture weapon, a collapsible baton or even a firearm. Like the proverbial loaded six-gun on the nightstand of old, a user can affix a pocket in a sleeping area which is out of sight of entry points, and rest well with the comfort of having defense tool in reach and the ready to service an intruder.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION of CERTAIN EMBODIMENTS

Figure 1:
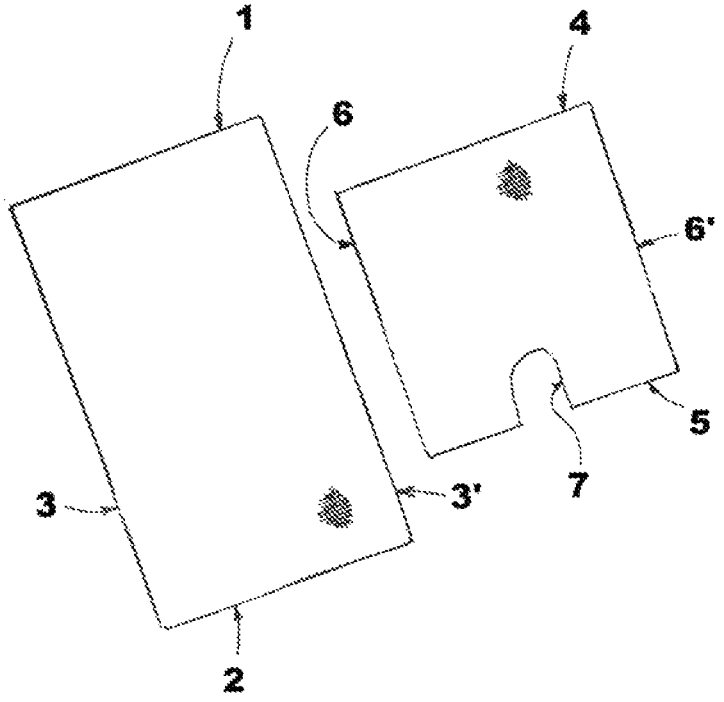
FIG. 1 shows two unassembled components of the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this specification the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Also, in this specification, a membrane may be of any of the various fabrics and sheet materials described herein, and as defined herein, "joining" of one membrane to another may be accomplished by a number of means depending on the materials being joined, including joining similar or dissimilar materials together. "Joining" may be done by sewing or stitching, by interposing an adhesive or a solvent between the membranes being joined, or melting and comingling materials, especially if one or both is a thermoplastic material, and allowing them to cool into at least a locally conjoined mass. Joining may also be accomplished by ultrasonic welding of appropriate membrane materials, including ultrasonic welding of dissimilar materials such as ABS (acrylonitrile butadiene styrene) and PVC (polyvinylchloride) including that the membranes have energy director features for ultrasonic welding. Joining in this specification also includes soldering, welding, or brazing of metallic materials or membranes made of composite materials which incorporate metal or metallic materials, coatings, sheets or meshes. "Joining" as defined in this specification also includes establishing an electrically conductive interconnection between conductive membranes or conductive components or materials incorporated into such membranes. Furthermore, "joining" may attach one membrane to another along a substantially linear, arcuate, or one-dimensional zone such as one membrane edge joined along another membrane edge, or joined at a seam, or joining may affix an area of a membrane to another area of itself or an area on another membrane.

Furthermore "joining" between one edge of a membrane to an edge or a surface of another membrane may be effected by a closure such as a zip-lock or slide fastener with interlocking members such as a zipper. A zip-lock in this specification includes any intermatable, re-closable interface in which one side offers at least one ridge for interdigitating with two or more complementary ridges on the other side of the interface. Zip-locks are commonly used in re-closable polyethylene bags for food storage and freezing and are also fashioned with conductive plastic materials used for storage, packaging, and protection of electronic parts from electrostatic discharge (ESD) and similar damage induced by electric fields or stray currents. Zip-locks are also commonly resistant to the passage of liquids through the interface.

An "adhesive" in this specification is any material which can be deposited on a surface or an object and allows it to cleave to or adhere to another object or surface. Adhesion may be temporary, semi-permanent, or permanent. Some adhesives allow an adhered object to be pulled off and re-adhered a number of times before effective adhesion wears off. Others cleave strongly only the first or second time they are used, and lose their adhesion strength and utility thereafter. Adhesion strength is defined in units of force divided by units of area, just like mechanical stress in materials.

Some adhesives provide little adhesion strength until acted upon by heat or mixed with a bonding agent. Thermosetting and thermoplastic adhesives are activated by heat.

Some processes, such as thermoplastic adhesion, are reversible and repeatable so that a second application of heat releases the affixed object and a third heating can adhere the object somewhere else.

Mixtures of 4,4'-methylenediphenyl diisocyanate (MDI) and a volatile solvent such as toluene, hexane, cyclohexane, or ketones or ethers are often supplied in repair kits for rubbery or flexible water resistant gear, such as foul weather garments, diving suits, and rubbery or flexible inflatable gear such as pneumatic tires, rafts, and balloons. Other adhesives for rubbery fabrics are created with diisocyanate compounds and low molecular weight polyols which function as cross-linking agents to establish and enhance bond strength. Still other adhesives suspend polymers such as vinyl or acetate or their prepolymers in volatile vehicles such as hexanes or ethers which evaporate and leave behind bonded interfaces. Some of these products can bond natural fiber fabrics together by diffusing polymer-bearing liquids into the fibers by surface tension capillary action, whereupon evaporation leaves these polymers bonded to them so that they mechanically connect adjacent fibers together. Rubber cement glue, milk-based glue, animal glue, and other collagens can also be used as an adhesive in accordance with the invention. Adhesives containing methyl ether, methyl ethyl ketone, dimethyl ether, or a diflouroethane such as 1,1 diflouroethane can also be used as an adhesive in accordance with the invention.

This specification is written using both metric (SI) units and US customary units. The abbreviation "in" refers to a US customary inch or fraction thereof, the abbreviation "dB" refers to a decibel as a relative order of magnitude, and "GHz" is an abbreviation for gigahertz as unit of frequency.

The invention is a portable and moveable pocket which in most embodiments can be made from woven or felted fabric, wool, cotton, linen, muslin, denim, twill cloth, drill cloth, silk, or leather; it can also be made from natural or synthetic fibers or any blend thereof, and can also be fashioned using any other flexible membrane material or blends of these and other materials including but not limited to polyvinylchloride (PVC,) acrylo-nitrile butadiene styrene (ABS,) polyacetate ("nylon®,") polypropylene, polyimide ("Kapton®,") polymethyl methacrylate (PMMA) polydimethylsiloxane (PDMS) polyurethane, and natural and synthetic rubbers such as buna-n, nitrile, ethyl propylene rubber (EPM,) ethylene propylene diene monomer (EPDM,) flouroelastomer ("Viton®," sometimes also called FKM) and thermoplastic rubber (TPR.)

Referring to FIG. 1, the pocket is formed by joining a rear membrane [1] having a perimeter [2,] to a front membrane [4] also having a perimeter [5.] Two portions of the front membrane perimeter which are first and second portions [6, 6'] are attached to the two portions of the rear membrane, ideally but not necessarily along first and second portions [3, 3'] respectively of its own perimeter. According to a preferred embodiment of the invention, the two membranes are rectangular and the perimeter of the front membrane also includes a concave portion [7] which in this specification is also referred to as a "cutout." The material for the front membrane may be a fabric or a sheet material and may comprise a non-transparent portion or boundary with another transparent material as a window so that displayed items on the screen of a device may be viewed while the device is retained within the pocket.

Figure 2:
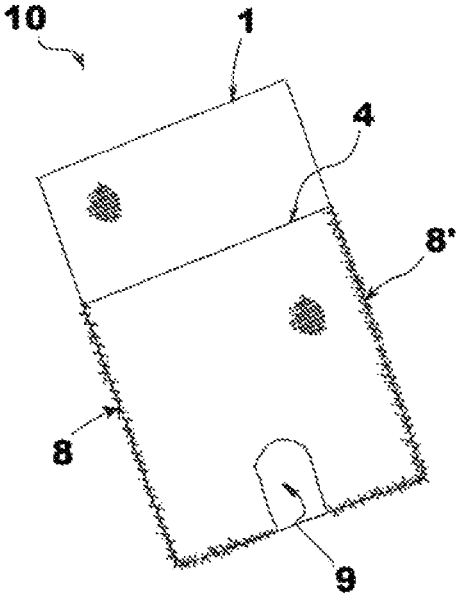
FIG. 2 shows an oblique view of the front of an embodiment of the invention.

Referring to FIG. 2, joining the two membranes [1] and [4] to form a pocket [10] in accordance with the invention is ideally accomplished by stitching two seams along two sections of the front membrane leaving a small gap between the joined sections which is centered along the bottom, conjoined edges of both rectangles. With the width dimension of both the front and rear membrane being equal, the lengths of the two joined portions [8, 8'] or stitched seams are also equal. The concave section of the front membrane perimeter is not stitched, which creates an aperture [9] that allows access at that location to a device retained within the pocket. Also as seen in both FIG. 1 and FIG. 2 and elsewhere, although the rear membrane is shown as a rectangle having at least one dimension larger than a corresponding dimension of the front membrane, other embodiments exist within the scope of the invention wherein a portion or all of a perimeter shape and size of a front membrane is identical or nearly identical to a corresponding portion or all of a perimeter shape and size of a rear membrane.

Figure 3:
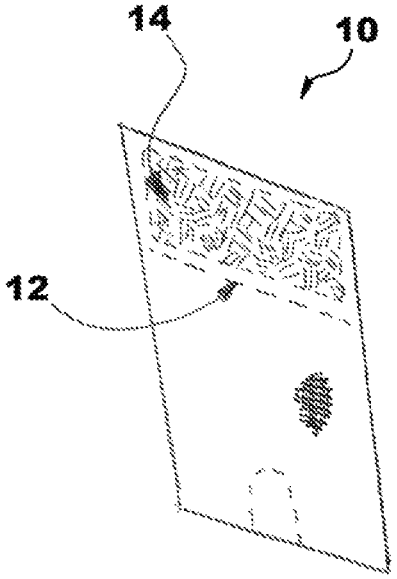
FIG. 3 shows an oblique view of the rear of an embodiment of the invention.

FIG. 3 shows an oblique view of the rear of an embodiment of the invention. The pocket [10] has a portion of its area [12] on the rear side of the rear membrane onto which adhesive [14] is deposited. Although a preferred area for adhesive to be applied is shown in this figure, it is also within the scope to apply the adhesive elsewhere, over a larger or a smaller area, over more than one area, or over the entire rear side of the rear membrane.

Figure 4:
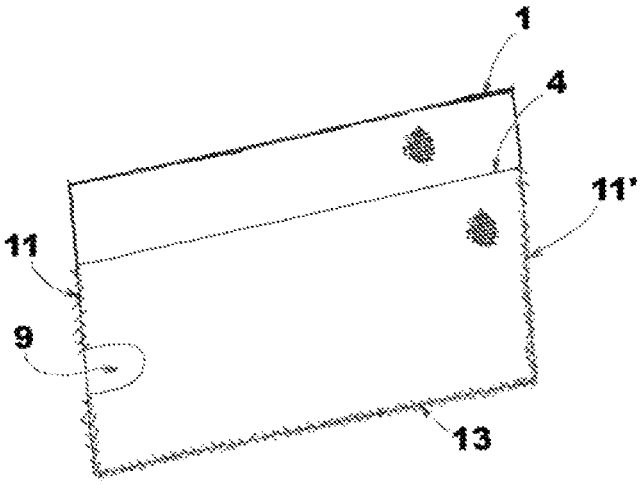
FIG. 4 shows an oblique view of the front of an alternative embodiment of the invention.

FIG. 4 shows an alternative embodiment of a pocket in accordance with the invention, as adapted to contain a substantially rectangular device which has a special at or near a midpoint of one of its shorter edges. The special feature can be a socket, data port, jack or a button. The cutout [9] in the front membrane [4] is located to align with or to be complementary to the special feature of the device. The two portions [11, 11'] of the front membrane perimeter which are joined to the rear membrane [1] are of unequal lengths, with the longer seam [11'] including the full length of the bottom edge [13] of the pocket.

In both types of embodiments shown in FIG. 2 and FIG. 4, it is seen that at least one joined portion of the front membrane perimeter originates at an end of a concave portion of that perimeter.

Figure 5:
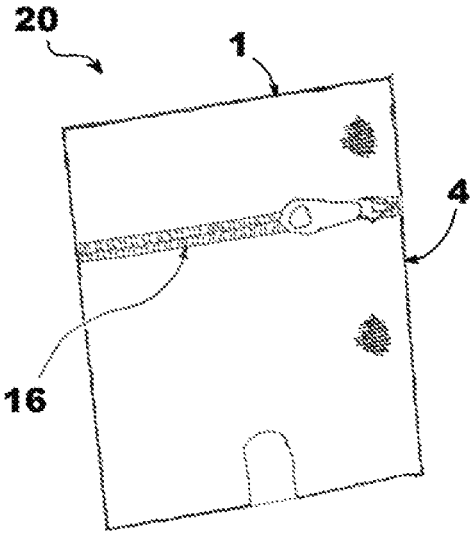
FIG. 5 shows an oblique view of the front of an alternative embodiment of the invention which includes a zipper as a closure.

FIG. 5 shows an alternative embodiment of a pocket [20] in accordance with the invention, wherein the front membrane [4] is joined to the rear membrane [1] around portions of the perimeters of the front and rear membranes as described previously, but also by a slide fastener with interlocking members, which in this embodiment is a zipper [16.] Other closures using slide members are contemplated within the scope of the invention, including but not limited to slides which engage or disengage one or more ribs on the interior of the front membrane with one or more complementary ribs on the rear membrane.

Figure 6:
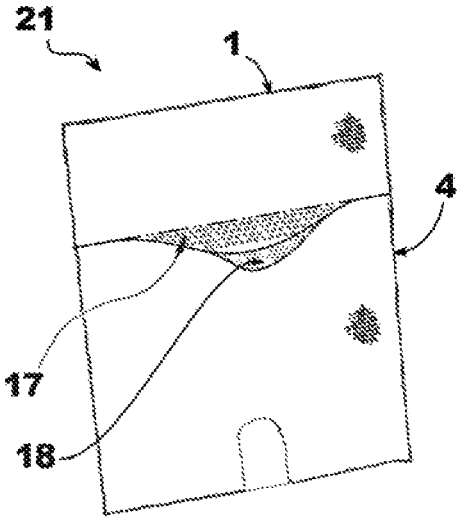
FIG. 6 shows an oblique view of the front of an alternative embodiment of the invention which includes hook-and-loop fabric as a closure.

FIG. 6 shows an alternative embodiment of a pocket [20] in accordance with the invention, wherein the front membrane [4] is joined to the rear membrane [1] around portions of the perimeters of the front and rear membranes as described previously, but the embodiment shown here also includes complementary hook-and-loop fabric [17, 18] such as Velcro® in strips on inner portions of the front and rear membranes so that a device can be inserted into the pocket and the lip of the front membrane [4] can be pressed onto the rear membrane to effect positive retention of the device within the pocket. The hook fabric may be deposited on either membrane, with complementary loop fabric located on the other membrane for mutual engagement. The features or textures of the [17] material may be different from and complementary to the material of [18,] or both materials may be identical and thus effect a hermaphroditic closure. An example of hermaphroditic closure material is both sides having mushroom-shaped protuberances which are aligned so that the heads of one side of the closure insert into the spaces between identical protuberances of the other side of the closure. Although many types of hermaphroditic closure materials are available for use in various embodiments of a portable pocket of the invention, specific examples of mushroom-type hermaphroditic materials are seen in U.S. Pat. No. 5,607,635 to Melbye et al and U.S. Pat. No. 3,408,705 to Kayser et al, both now expired and in the public domain.

The front membrane may further comprise at least one aperture located anywhere as convenient for direct physical or tactile access to buttons, switches, controls, terminals, sockets, or jacks on a device contained inside the pocket.

Best mode adhesives include acrylic adhesive, adhesive transfer tape, liquid set adhesive, and reusable adhesive. Adhesive transfer tape typically comprises a thin film of pressure-sensitive acrylic glue on a peel-off strip, and is usually employed as an alternative to hot melt glues, liquid adhesives, or physical fasteners. Other transfer adhesives are furnished with one or both sides covered by a peel-off sheet. An embodiment in accordance with the invention includes a peel-off sheet which is applied to cover the adhesive until it is desired to install the pocket membrane at a dedicated location. Other adhesives are iron-on adhesives which exhibit mild yet sufficient adhesion strength to be affixed at a number of preliminary or temporary locations, and once a more permanent location is decided, a heat source such as a clothes iron can be pressed onto the frontside of the pocket membrane. The heat from the source activates the iron-on adhesive, which then bonds much more permanently to the surface of the object in contact with this adhesive. Some iron-on adhesives are machine washable, so that a pocket of the invention permanently affixed to a fabric item such as a garment, pillow case, or bed sheet can pass through a laundry cycle and remain attached while both articles are cleaned together.

Reusable adhesives are those which can be affixed to surfaces and removed a number of times. One common product isa sticky polyurethane which adheres very well to all hard, non-porous surfaces. When furnished as a tape it can be easily peeled off without leaving any residue and reapplied. If the adhesive picks up any dust or dirt it can be washed with water to refresh its adhesive strength. One limitation occurs when during a removal the adhesive sticks to the wall or applied surface of the pocket invention rather than remaining affixed to a pocket of the invention. In that event the adhesive can be pulled off and re-applied to the pocket.

Various other embodiments in accordance with the invention also include iron-on adhesive or other adhesives by which to affix a pocket to a garment may also be furnished in colored or patterned materials or fabrics so that a user can select a style, design, or other factors of ornamentality that best accord with the underlying garment.

A pocket embodiment or a pocket membrane embodiment in accordance with the invention may be fashioned so that a device fits entirely within a cavity of the invention or mostly fits within said cavity with a top portion of the device peeping out of the pocket. This type of embodiment is convenient and preferred for a device having controls along its top or top front, and also allow the device to be grasped directly when it is wanted to remove the device from the pocket cavity. However, unless the device is retained in the pocket cavity by some degree of interference fit plus some stretchy compliance of the membrane material, this embodiment is less preferred if attached to upper body garments, or portable objects where a substantial risk of inverting the pocket cavity exists and where a device could slip out of such an inverted pocket cavity, fall free, and be damaged or lost.

Figure 7:
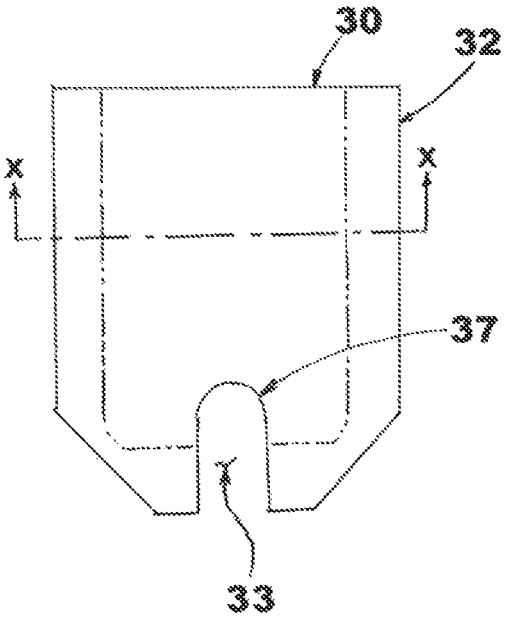
FIG. 7 shows a front view of an alternative embodiment of the invention, including a section line x-x for the cross-section FIG. 9*a*.
Figure 9A:
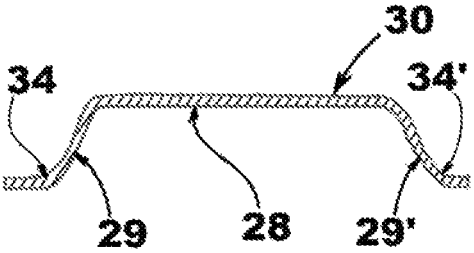
FIG. 9*a* shows a bottom view of an alternative embodiment of the invention.
Figure 9B:
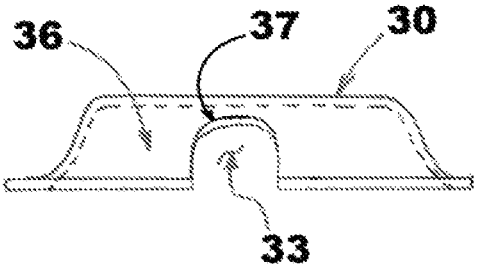
FIG. 9*b* shows a cross-section view of an alternative embodiment of the invention, taken from the section line x-x shown in FIG. 7.

FIG. 7 shows a front view of an alternative embodiment [30] of the invention, including a section line x-x for the cross-section FIG. 9*b*. The pocket membrane has a central loft section with a ceiling, two sidewalls, an end wall at its bottom, and an aperture [33] which in this case extends into the ceiling of the loft section, and also includes a concave portion [37] as part of its perimeter.

Figure 8:
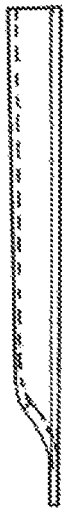
FIG. 8 shows a right-side view of an alternative embodiment of the invention.

FIG. 8 shows a right-side view of this embodiment of the invention as depicted in FIG. 7.

FIG. 9*a* shows a cross-section view of an alternative embodiment of the invention, taken from the section line x-x shown in FIG. 7. Here can be seen more clearly the ceiling [28] and the two sidewalls [29, 29'] and also in this embodiment there are flanges [34, 34'] extending from each of said two sidewalls. In this embodiment each flange extends outwardly from its sidewall, that is, they extend away from the ceiling portion of the loft section.

FIG. 9*b* shows a bottom view of an alternative embodiment [30] of the invention, in which the pocket membrane has a central loft section with a ceiling, two sidewalls, an end wall [36] at its bottom, and an aperture [33] which in this case does not extend into the ceiling of the loft section but only pierces in twain the end wall and the flange which extends from the end wall. This aperture also includes a concave portion [37] as part of its perimeter.

Figure 9C:
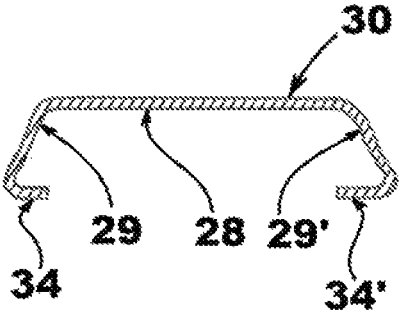
FIG. 9*c* shows a cross-section view of another alternative embodiment of the invention.

FIG. 9*c* shows a cross-section according to an alternative embodiment [30] of the invention, with the ceiling [28] and sidewalls [29, 29'] of a loft section as previously described, but with the flanges [34, 34'] turned inwardly from their attachment to the sidewalls. Although not shown in this cross-section, this embodiment may also include an end wall attached to the ceiling, and one or more end wall from which flanges may extend outwardly or inwardly or both. The end wall may also further comprise an aperture, an aperture having a concave portion of its perimeter, and that aperture may also extend into the ceiling portion of the loft section.

Figure 10:
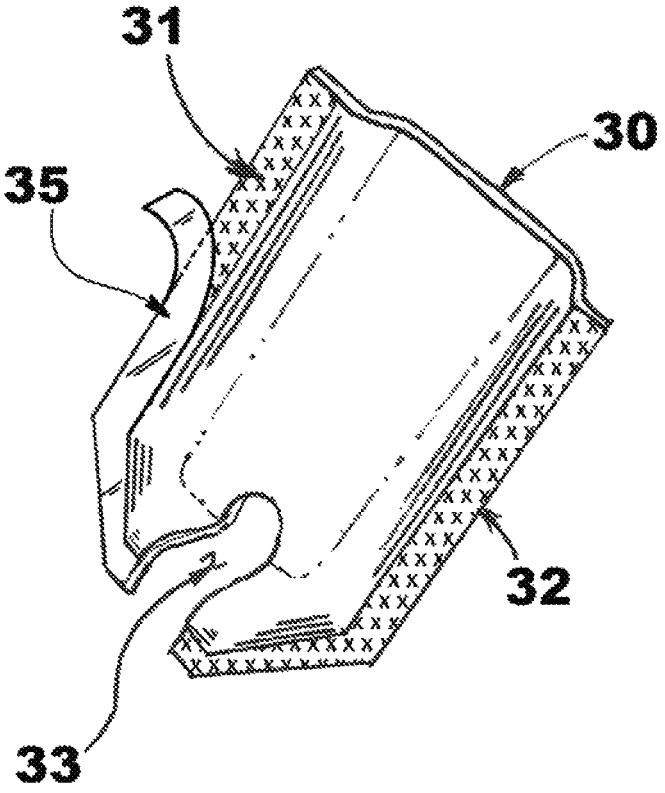
FIG. 10 shows an oblique rear shows view of an alternative embodiment of the invention.

FIG. 10 shows an oblique rear shows view of a preferred embodiment [30] of the invention which is a pocket membrane. This embodiment includes a loft section with a ceiling, two sidewalls and an end wall. The end wall and the flange extending from the end wall are pierced in twain by am aperture [33] which in this case extends into the ceiling portion of the pocket membrane. Flanges [31] and [32] extend from the two sidewalls of the loft section, and an adhesive is deposited onto preferably all but at least a portion of the rear-facing surfaces of at least two flanges. Some adhesives may be pressure sensitive and may adhere to and be pulled off from various surfaces a number of times, allowing convenient and temporary location of the pocket membrane and easy re-location of it at the desire of the user. Other adhesives in accordance with the invention are thermally sensitive and with the application of heat these can be made to bond semi-permanently or permanently to objects or surfaces as desired.

Since some adhesives can repeatedly adhere a only few times before losing their effectiveness, and other may pick up dust or foreign matter over time which is another mode by which they lose adhesion strength, when these adhesives are incorporated into the invention, their adhesiveness may be preserved until use by protecting the adhesive-coated flanges of such an embodiment with a peel-off sheet or peel-off strip.

One of the most useful applications of the invention is for various embodiments sized to receive a cell-phone, a smartphone, or an iPod®. Materials for these embodiments can be selected from thin and flexible transparent sheet materials such as polyethylene, acrylonitrile butadiene styrene, and polyvinyl chloride. These and other thin, flexible clear sheets allow the user to view items displayed on the screen of the device, and also transmit tactile inputs to operate touch screens and physical buttons or switches, so that a user may operate the device while it is retained in a pocket or a pocket membrane in accordance with the invention. Thin flexible sheet materials also allow swiping inputs and fingerprint detection and recognition while a device is retained in a pocket or a pocket membrane of the invention. The inventor has discovered that materials which are as opaque as 72% translucent can still be used to view displayed items on a smartphone screen while the smartphone is retained within a pocket or pocket membrane of the invention.

Many materials are available which conduct electricity well enough to dissipate local concentrations of static electricity or, when formed into a pocket which substantially envelops a hand-held electronic device or at least its electromagnetic radiating components so as to form a Faraday cage around the device for electromagnetic isolation and trapping unwanted or non-consensual emissions from the device. Materials for the invention are available which incorporate conductive mesh or conductive micro mesh, or thin transparent EMI shielding film comprising a polymer basecoat and crosslinked polymer transparent dielectric layer.

Some shielding materials incorporate a plurality of metal nanowires and conductive nanoparticles. Nanoparticles have a size of less than 1000 nanometers and nanowires have a diameter of less than 1000 nanometers. Nanowires and nanoparticles can comprise gold, silver, copper, indium, palladium, aluminum, iron, cobalt, nickel, an alloy thereof, an oxide thereof, or a mixture thereof. Some transparent EMI shielding materials are available in thicknesses of 0.003 in to 0.008 in and are furnished with their own adhesive on one side. These may be affixed to other materials to form a front membrane or a rear membrane in accordance with to invention, or both. In these embodiments one or both membranes of the invention are in fact layered composite materials. A portable pocket in accordance with the invention, when made from radiation attenuating material having such conductive particles or wires will create a Faraday cage around the electronic device contained within it and exhibit the same attenuation properties of the sheet materials which comprise the front and rear membranes of the invention. Radiation attenuating sheets and films are available which are about 72% transparent and can attenuate electromagnetic radiation over 50 dB (99.99%) over a spectrum of 1 GHz to 10 GHz.

Two benefits of trapping electromagnetic emissions from a device are first, reclaiming personal privacy by interdicting unwanted auto-generated transmissions of information about a user's whereabouts or device usage, input history or browsing history, or other personal use or private information stored on the device, and second, that other equipment in range of the device may be sensitive to its spurious emissions, and by placing an electrically noisy device in a Faraday cage, its electromagnetic interference (EMI) can be suppressed.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A pocket comprising a front membrane having a front membrane perimeter comprising a first bottom edge, said front membrane further comprising at least one aperture extending upwards from the first bottom edge, a rear membrane having a rear membrane perimeter comprising a second bottom edge, said rear membrane further comprising an adhesive, with first and second portions of said front membrane perimeter joined respectively to first and second portions of said rear membrane perimeter, and with said first bottom edge joined to said second bottom edge.

2. The pocket of claim 1, wherein the said rear membrane is a rectangle having a width dimension, and said front membrane has a width dimension equal to said rear membrane width dimension.

3. The pocket of claim 1, wherein a length of said first portion of said front membrane perimeter joined to said first portion of said rear membrane perimeter is equal to a length of said second portion of said front membrane perimeter joined to said second portion of said rear membrane perimeter.

4. The pocket of claim 1, further comprising a material selected from the set of materials consisting of:

natural fiber, denim, silk, twill, drill cloth, polyester, vinyl, rayon, silk, taffeta, muslin, linen, wool, felt, leather, synthetic fiber, mylar, acetate, polyvinylchloride, acrylo-nitrile butadiene styrene, polyacetate, polypropylene, polyimide, polymethyl methacrylate, polydimethylsiloxane, polyurethane, rubber, such as buna-n rubber, nitrile rubber, ethyl propylene rubber, ethylene propylene diene monomer, flouroelastomer, and thermoplastic rubber.

5. The pocket of claim 1, wherein a portion of said front membrane perimeter is concave.

6. The pocket of claim 5, wherein at least one portion from among said first and second portions of said front membrane perimeter originates at an end of said concave portion of said front membrane perimeter.

7. The pocket of claim 1, wherein said front membrane is joined to said rear membrane by a slide fastener with interlocking members.

8. The pocket of claim 1, wherein said front membrane is joined to said rear membrane by a zip-lock.

9. The pocket of claim 1, further comprising a material selected from the set of materials consisting of:

conductive mesh, conductive micro mesh, conductive nanowires, conductive nanoparticles, gold, silver, copper, indium, palladium, aluminum, iron, cobalt, nickel, EMI shielding film, and radiation attenuating material.

10. The pocket of claim 1, wherein said adhesive comprises a material selected from the set of materials consisting of:

rubber cement glue, animal glue, milk-based glue, collagen, a thermosetting adhesive, a thermoplastic adhesive, an isocyanate, a diisocyanate, toluene, hexane, a volatile solvent, a polyol, a low molecular weight polyol, vinyl, acetate, an ether, a ketone, methyl ethyl ketone, hexane, cyclohexane, a difluoroethane, 1,1 diflouroethane, acrylic adhesive, adhesive transfer tape, liquid set adhesive, and a reusable adhesive.

11. The pocket of claim 1, wherein said adhesive is covered by a peel-off sheet.

12. A pocket membrane comprising a loft section having a ceiling and two sidewalls, with flanges extending from each of said two sidewalls, and an adhesive deposited on at least a portion of each of said flanges, with said loft section further comprising an end wall and said end wall further comprising an aperture extending into the ceiling of the loft section.

13. The pocket membrane of claim 12, wherein said end wall further comprises a flange extending from said end wall.

14. The pocket membrane of claim 13, wherein a portion of a perimeter of said aperture is concave.

15. The pocket membrane of claim 13, wherein a portion of said aperture extends into said ceiling of said loft section.

16. The pocket of claim 12, further comprising a material selected from the set of materials consisting of:

natural fiber, denim, silk, twill, drill cloth, polyester, vinyl, rayon, silk, taffeta, muslin, linen, wool, felt, leather, synthetic fiber, mylar, acetate, polyvinylchloride, acrylo-nitrile butadiene styrene, polyacetate, polypropylene, polyimide, polymethyl methacrylate, polydimethylsiloxane, polyurethane, rubber, such as buna-n rubber, nitrile rubber, ethyl propylene rubber, ethylene propylene diene monomer, flouroelastomer, and thermoplastic rubber.

17. The pocket of claim 12, wherein at least one of said flanges extends outwardly from its sidewall.

18. The pocket of claim 12, wherein at least one of said flanges extends inwardly from its sidewall.

19. The pocket of claim 12, wherein adhesive deposited on least one of said flanges is covered by a peel-off strip.

20. The pocket of claim 12, further comprising a material selected from the set of materials consisting of:

conductive mesh, conductive micro mesh, conductive nanowires, conductive nanoparticles, gold, silver, copper, indium, palladium, aluminum, iron, cobalt, nickel, EMI shielding film, and radiation attenuating material.

21. The pocket of claim 12, wherein said adhesive comprises a material selected from the set of materials consisting of:

rubber cement glue, animal glue, milk-based glue, collagen, a thermosetting adhesive, a thermoplastic adhesive, an isocyanate, a diisocyanate, toluene, hexane, a volatile solvent, a polyol, a low molecular weight polyol, vinyl, acetate, an ether, a ketone, methyl ethyl ketone, hexane, cyclohexane, a difluoroethane, 1,1 diflouroethane, acrylic adhesive, adhesive transfer tape, liquid set adhesive, and a reusable adhesive.

* * * * *